US010801265B1

(12) United States Patent
Russo et al.

(10) Patent No.: US 10,801,265 B1
(45) Date of Patent: Oct. 13, 2020

(54) COMBINATION CORING MACHINE AND VACUUM EXCAVATION RIG

(71) Applicant: Tellus Underground Technology, Inc., Portland, PA (US)

(72) Inventors: Frank Russo, Swiftwater, PA (US); Ronald Lyon, Bangor, PA (US); Carl Brunner, Bangor, PA (US)

(73) Assignee: TELLUS UNDERGROUND TECHNOLOGY, INC., Portland, PA (US)

( * ) Notice: Subject to any disclaimer, the term of this patent is extended or adjusted under 35 U.S.C. 154(b) by 0 days.

(21) Appl. No.: 16/455,032

(22) Filed: Jun. 27, 2019

(51) Int. Cl.
*E21B 7/02* (2006.01)
*E21B 10/02* (2006.01)

(52) U.S. Cl.
CPC ..... *E21B 7/023* (2013.01); *E21B 7/022* (2013.01); *E21B 7/027* (2013.01); *E21B 10/02* (2013.01)

(58) Field of Classification Search
CPC . E21B 7/02; E21B 7/024; E21B 10/02; E21B 7/023; E21B 7/027
See application file for complete search history.

(56) References Cited

U.S. PATENT DOCUMENTS 4,671,367 A * 6/1987 Brunsing ..... E02D 27/42 175/253
2018/0087338 A1* 3/2018 Hau ..... E21B 25/00

* cited by examiner

*Primary Examiner* — Kristyn A Hall
(74) *Attorney, Agent, or Firm* — Perkins Coie LLP

(57) ABSTRACT

A core drill apparatus includes a swing arm pivotably couplable to a mobile platform and a core drill carried by the swing arm. The core drill being movable via the swing arm between a stowed position and a deployed position with respect to the mobile platform. An excavation rig incorporating the same is also provided.

21 Claims, 5 Drawing Sheets

COMBINATION CORING MACHINE AND VACUUM EXCAVATION RIG

TECHNICAL FIELD

This patent application is directed to excavation systems, and more specifically, to core drilling and vacuum excavation systems.

BACKGROUND

Locating underground utilities is a problem that affects nearly all construction workers and excavators when performing their work. Cities are full of telephone wires, power and fiber optic cables, gas and water mains, sewer pipes and waste water drains and more, some even dating back to the 19th century or earlier in some countries. Locating, not to mention accessing, all of these different utilities can be a difficult process. Many of these utilities are delicate if not dangerous to excavate (e.g., gas lines). Technology has been developed to excavate utilities by using high-pressure air and/or water to dislodge soil around the utilities while vacuum excavating the spoils of the excavation as it is dislodged. In many cases the utilities are located under pavement (e.g., asphalt or concrete) which must be removed before excavation can commence. Generally, a core drill is employed to cut a hole in the pavement above the utility line of interest. Traditionally, these core drills are mounted to dedicated trailers or skid steers, for example. Thus, in order to access a utility line for repairs and/or inspection, a core drill must first be called to the site to cut the access hole and then an excavation rig is scheduled to perform the excavation, followed by the actual repair/inspection. All of these steps require scheduling, separate equipment, and likely different contractors to perform all of the steps in the process. Accordingly, there is a need for improved technology to more efficiently and cost effectively access utilities located under roads, parking lots, and other paved surfaces.

BRIEF DESCRIPTION OF THE DRAWINGS

The combination coring machine and vacuum excavation rig described herein may be better understood by referring to the following Detailed Description in conjunction with the accompanying drawings, in which like reference numerals indicate identical or functionally similar elements.

Figure 1A:
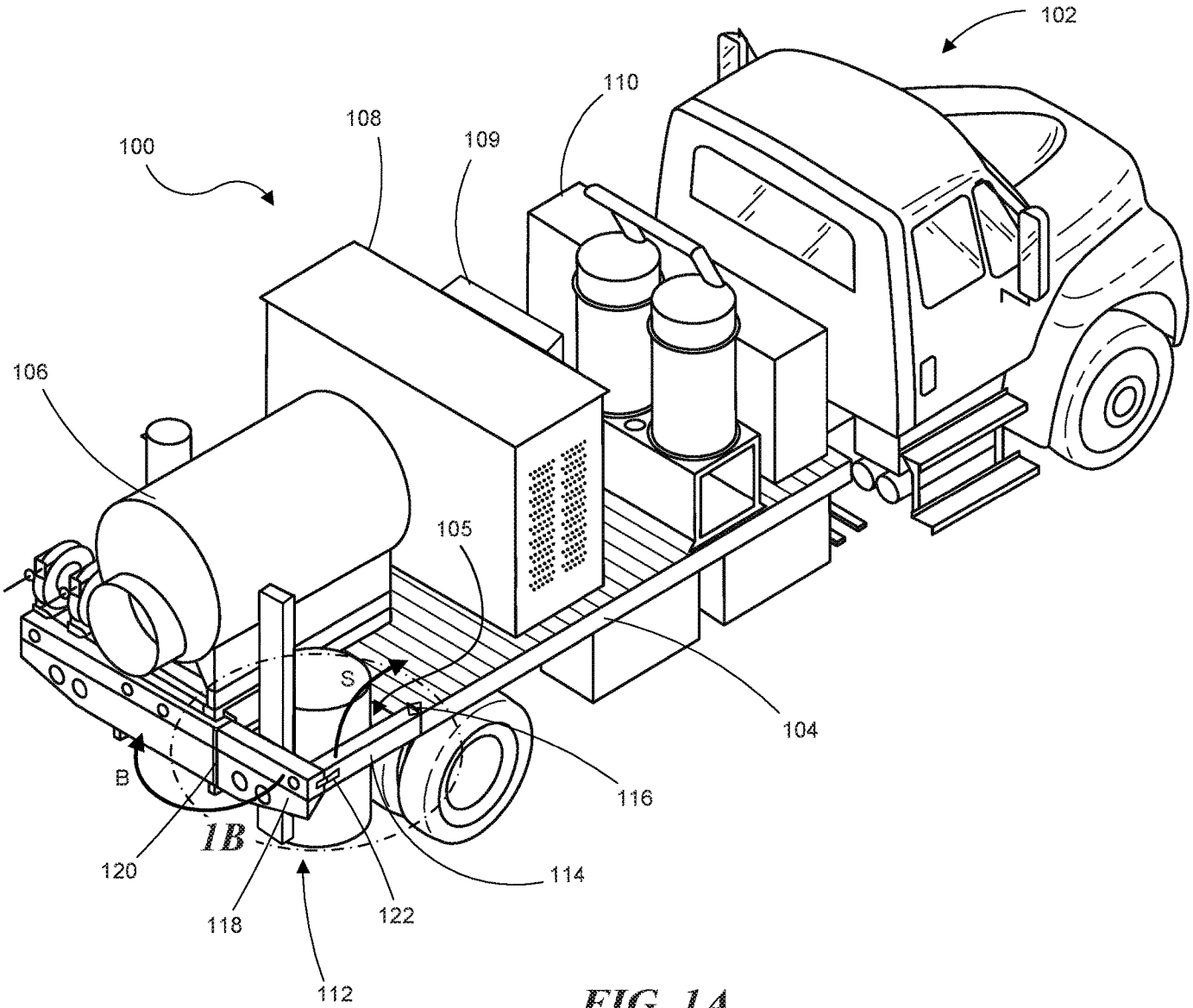
FIG. 1A is an isometric view of a combination coring machine and vacuum excavation rig according to a representative embodiment of the disclosed technology.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, combinations, equivalents, and alternatives falling within the scope of the technology disclosed herein.

DETAILED DESCRIPTION

Overview

The disclosed technology provides for combining a core drill apparatus and vacuum excavation equipment on a single mobile platform. The disclosed combination coring machine and vacuum excavation rig allows for locating, core drilling, excavating, and inspecting/repairing a utility line with a single rig and crew. In a representative embodiment, an excavation rig can include a mobile platform, such as a vehicle or trailer with various excavation systems mounted thereto. Such systems can include a vacuum system, a compressed air system, and a high pressure water system, for example. In addition, a core drill can be pivotably coupled to the mobile platform and movable between a stowed configuration for transport and a deployed configuration for core drilling operations. In some implementations, the mobile platform is a vehicle (e.g., truck) that includes a flatbed having a notch positioned to receive the core drill when the core drill is in the stowed configuration. The core drill can be pivotably coupled to the vehicle via a swing arm coupled to a frame of the vehicle.

General Description

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

Figure 1B:
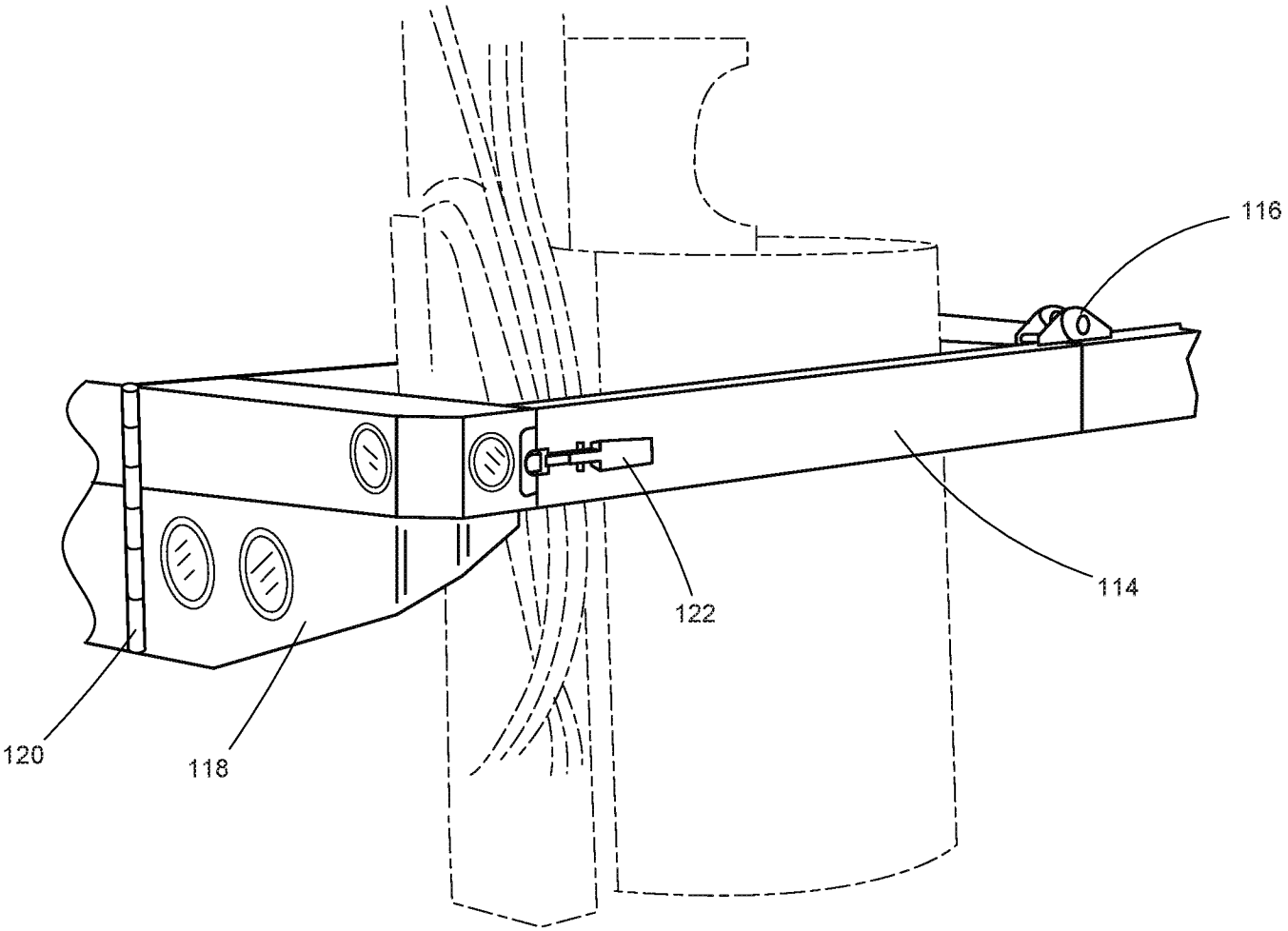
FIG. 1B is an enlarged partial perspective view of a notch region formed in the flatbed of the truck shown in FIG. 1A.

FIG. 1A illustrates a combination coring machine and vacuum excavation rig 100 according to a representative embodiment. The excavation rig 100 can include a mobile platform, such as truck 102, which has a flatbed 104. Various excavation systems can be mounted to flatbed 104, such as a spoils tank 106, an engine/air compressor module 108, a vacuum producer and high-pressure water system module 109, and a filtration system 110. The excavation rig 100 also includes a core drill apparatus 112 that is stowed in a notch region 105 formed in the flatbed 104. The core drill apparatus 112 is partially surrounded in the notch region 105 by a side-rail segment 114 and a bumper segment 118. Each of these segments can be rotated clear of the notch region 105 in order to allow the core drill apparatus 112 to swing away from the truck 102 for drilling operations. The side-rail segment 114 can rotate upwards about a horizontal axis corresponding to hinge 116 as indicated by arrow S. The bumper segment 118 can rotate about a vertical axis corresponding to hinge 120 as indicated by arrow B. With further reference to FIG. 1B, in some embodiments the bumper hinge 120 can be a plano hinge, for example. In some implementations, a latch 122 can connect the side-rail segment 114 and the bumper segment 118 in their respective closed/stowed positions.

Figure 2:
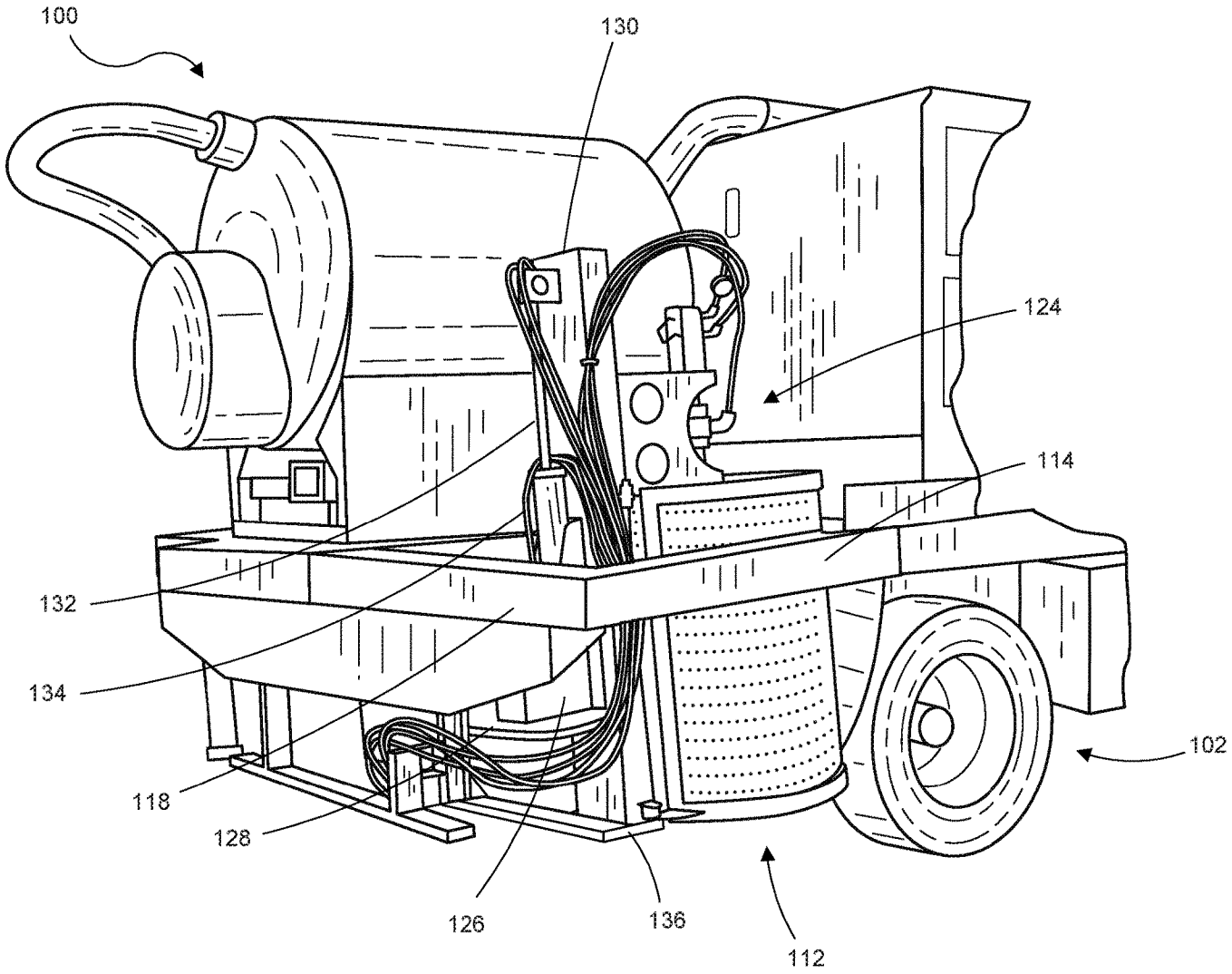
FIG. 2 is a partial perspective view illustrating a core drill apparatus coupled to an excavation rig in a stowed position.

As shown in FIG. 2, the core drill apparatus 112 can include a core drill 124 carried by a pivot frame 126 via an elongate lift frame 130. The pivot frame 126 can be pivotably coupled to a swing arm 128 that is pivotably coupled to the mobile platform. In some embodiments, the vertical position of the core drill 124 can be adjusted by moving the lift frame 130 relative to the pivot frame 126. A lift actuator, such as hydraulic cylinder 132, can be connected between the pivot frame 126 and the lift frame 130 to raise and lower the core drill 124. A hydraulic pump and controls (not shown) can be connected to the hydraulic cylinder 132 via hoses 134 to operate the cylinder. In some embodiments, the truck 102 can include a support platform 136 upon which the core drill 124 can rest when the core drill apparatus 112 is in the stowed configuration, as shown in FIG. 2.

Figure 3:
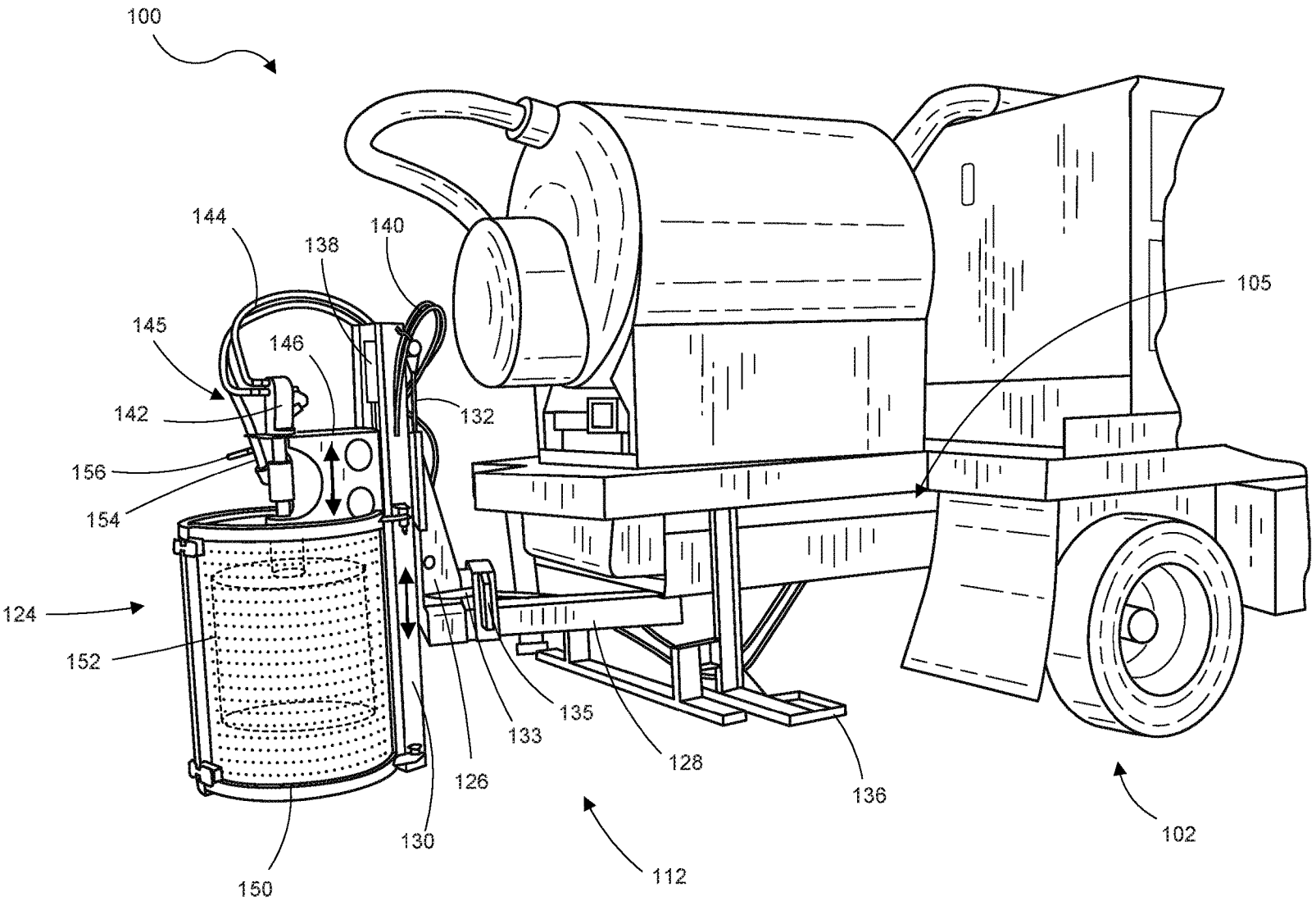
FIG. 3 is a partial perspective view illustrating the core drill apparatus of FIG. 2 in a deployed position.

With reference to FIG. 3, the core drill 124 can swing out of the notch region 105 and away from the truck 102 to a deployed positioned for drilling operations. The side-rail segment 114 and the bumper segment 118 have been removed from FIG. 3 for clarity. In operation, however, the side-rail segment 114 and the bumper segment 118 can be rotated out of the way as described above with respect to FIGS. 1A and 1B. The core drill 124 can be pivoted on the pivot frame 126 and the swing arm 128 to facilitate maneuvering the drill into the desired position. Once in position, the core drill 124, including lift frame 130, can be lowered onto the pavement with actuator 132. In some embodiments, a brake can be mounted at each pivot. For example, a brake disc 133 can be mounted on the pivot frame 126 and a hydraulic caliper 135 can be mounted on the swing arm 128 to selectively clamp the disc 133 when the core drill 124 is in the desired position. A second brake (not shown) can be positioned at the opposite end of the swing arm 128.

In some embodiments, the core drill 124 can include the lift frame 130, a drill head 145 carried by the lift frame 130, and a core saw 152 coupled to the drill head 145. The drill head 145 can include a drill bracket 146 movably coupled to the lift frame 130 and a drill motor 142 carried by the drill bracket 146. The drill motor 142 can be a hydraulic motor powered via hoses 144, or other suitable rotary actuator (e.g., electric or pneumatic). The drill motor 142 is coupled to the core saw 152 to rotate the saw. A head actuator, such as hydraulic cylinder 138 powered via hoses 140, can be connected between the lift frame 130 and the drill bracket 146 to raise and lower the drill motor 142 and the core saw 152 relative to lift frame 130. In other embodiments, the lift actuator 132 and head actuator 138 can be pneumatic or electric (e.g., ball screw actuator). In some embodiments, the core drill 124 further includes a saw guard 150 attached to the lift frame 130. In some embodiments, a supply line 154 provides cutting fluid (e.g., water) to the core saw 152 to cool an lubricate the saw during operation. The flow of fluid can be controlled with a ball valve 156, for example.

Figure 4:
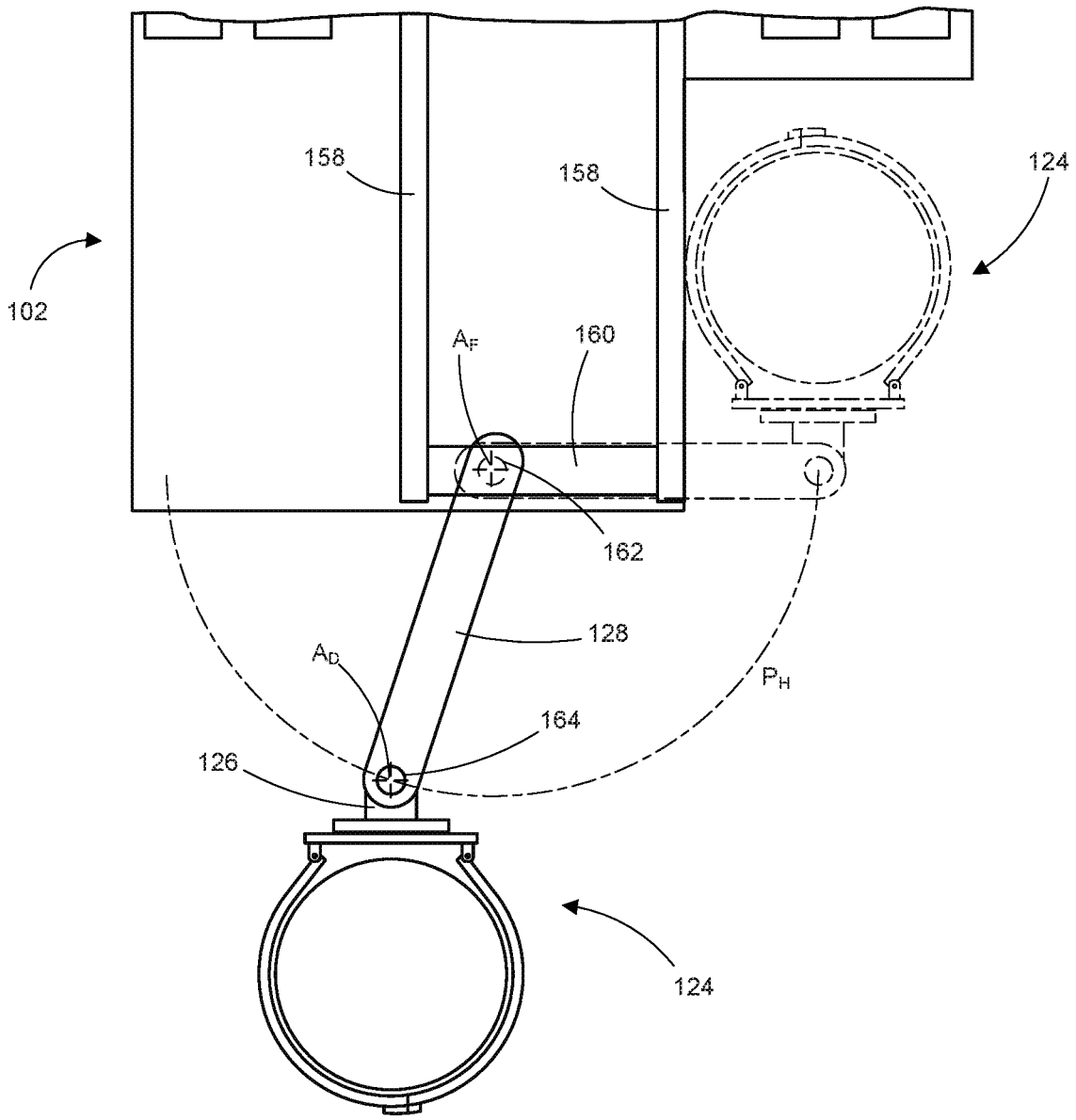
FIG. 4 is a schematic top plan view of a core drill apparatus illustrating the core drill apparatus swing arm arrangement.

As illustrated in FIG. 4, the swing arm 128 can be coupled, at a first end portion, to the frame rails 158 of truck 102 with a cross-member 160 attached (e.g., bolted or welded) to the frame rails 158. The swing arm 128 can rotate on a frame joint, such as a frame pin 162, about a substantially vertical axis $A_F$. The pivot frame 126 can rotate on a drill joint, such as drill pin 164, about a substantially vertical axis $A_D$ at a second end portion of the swing arm 128. Accordingly, the swing arm 128 rotates in a substantially horizontal plane $P_H$. In some embodiments, axis $A_F$ and axis $A_D$ are orthogonal to the frame rails 158 and plane $P_H$ is, therefore, parallel with the frame rails 158. In some embodiments, the frame joint and/or the drill joint can be articulated to angle the swing arm 128 and/or pivot frame 126 relative to the frame rails 158 in order to adjust the angle of the core drill 124 relative to the pavement (e.g., level the core drill 124 relative to the pavement). In some embodiments, the truck 102 can include hydraulic jacks (not shown) on both sides of the truck (e.g., behind the rear wheels) to level the truck in the side to side plane. In some embodiments, the truck 102 can include hydraulic jacks (not shown) proximate the front end of the truck 102 to level the truck in the front to back plane, as well.

With reference to FIGS. 1A-4, a representative method of operating the above described combination coring machine and vacuum excavation rig 100 can include transporting the excavation rig 100 to a work site. It should be noted that the excavation rig 100 can transport a vacuum excavation system and a coring machine to a work site on a single mobile platform e.g., truck 102. Once at the site, a utility of interest can be located with known techniques. In other embodiments, the utility can be previously located and marked. The truck 102 is positioned adjacent the location of interest. Next, the side-rail segment 114 and the bumper segment 118 are rotated clear of the notch region 105. In some embodiments, the side-rail segment 114 and the bumper segment 118 can be removed from the bed 104. In some embodiments, the core drill 124 can be lifted from support platform 136 with lift actuator 132. Once the core drill 124 is clear of the support platform 136, the core drill is positioned over the utility by rotating swing arm 128 and pivot frame 126 as needed. After the core drill 124 is positioned over the utility line location of interest, the core drill is lowered with lift actuator 132 until the lift frame 130 rests on the pavement. Next, the drill motor 142 is activated to rotate core saw 152. As the core saw 152 rotates, the head actuator 138 advances the drill head 145 toward the pavement. As the core saw 152 cuts into the pavement, cutting fluid can be dispensed via supply line 154 and valve 156. After the core hole is complete, the core drill 124 can be moved to the stowed position in reverse of the above described steps. Next, the utility can be excavated using the spoils tank 106, the engine/air compressor module 108, the vacuum producer and high-pressure water system module 109, and the filtration system 110, as appropriate. Repairs and/or inspection of the utility can be performed and the hole filled in with the original material and/or supplemental material. The pavement core cut from the hole can be replaced and sealed and/or grouted in place.

REMARKS

The above description, drawings, and appendices are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A core drill apparatus, comprising:

a swing arm adapted to be pivotably coupled to a mobile platform;

a pivot frame pivotably coupled to the swing arm; and a core drill carried by the pivot frame, wherein the core drill is movable via the swing arm and the pivot frame between a stowed position and a deployed position with respect to the mobile platform.

2. The core drill apparatus of claim 1, wherein the swing arm pivots in a substantially horizontal plane when coupled to the mobile platform.

3. The core drill apparatus of claim 1, wherein the core drill comprises a lift frame, a drill head carried by the lift frame, and a core saw coupled to the drill head.

4. The core drill apparatus of claim 3, wherein the drill head comprises a drill bracket movably coupled to the lift frame and a drill motor carried by the drill bracket.

5. The core drill apparatus of claim 3, wherein the core drill further comprises a head actuator positioned to move the drill head along the lift frame.

6. The core drill apparatus of claim 3, wherein the core drill further comprises a saw guard attached to the lift frame.

7. The core drill apparatus of claim 1, further comprising a mobile platform.

8. A core drill apparatus mountable to a mobile platform, the drill core apparatus comprising:

a swing arm pivotably couplable to the mobile platform;

a pivot frame pivotably coupled to the swing arm;

an elongate lift frame carried by the pivot frame; and a drill head carried by the lift frame.

9. The core drill apparatus of claim 8, further comprising a core saw carried by the drill head.

10. The core drill apparatus of claim 8, further comprising a core saw guard carried by the lift frame.

11. The core drill apparatus of claim 8, wherein the drill head comprises a drill bracket movably coupled to the lift frame and a drill motor carried by the drill bracket.

12. The core drill apparatus of claim 8, wherein the core drill further comprises a head actuator positioned to move the drill head along the lift frame.

13. The core drill apparatus of claim 8, further comprising a lift actuator positioned to move the lift frame relative to the pivot frame.

14. An excavation rig, comprising:

a vehicle including a flatbed having a notch;

a vacuum system mounted to the vehicle; and a core drill pivotably coupled to the vehicle and movable between a stowed configuration and a deployed configuration, wherein the notch is positioned in the flatbed to receive the core drill when the core drill is in the stowed configuration.

15. The excavation rig of claim 14, further comprising a compressed air system mounted to the vehicle and a high pressure water system mounted to the vehicle.

16. The excavation rig of claim 14, wherein the core drill is pivotably coupled to the vehicle via a swing arm coupled to a frame of the vehicle.

17. The excavation rig of claim 16, wherein the swing arm pivots in a substantially horizontal plane.

18. The excavation rig of claim 14, wherein the core drill comprises a lift frame, a drill head carried by the lift frame, and a core saw coupled to the drill head.

19. The excavation rig of claim 18, wherein the drill head comprises a drill motor movably coupled to the lift frame.

20. The excavation rig of claim 18, wherein the core drill further comprises a head actuator positioned to move the drill motor along the lift frame.

21. The excavation rig of claim 18, wherein the core drill further comprises a saw guard attached to the lift frame.

* * * * *